United States Patent [19]

Bundschuh

[11] 4,452,379

[45] Jun. 5, 1984

[54] PUMP DISPENSER WITH ONE-PIECE STRETCHABLE BIASING MEMBER AND VALVE

[76] Inventor: Robert L. Bundschuh, 6534 Miami Lakes Dr. East, Miami Lakes, Fla. 33014

[21] Appl. No.: 396,833

[22] Filed: Jul. 9, 1982

[51] Int. Cl.[3] ..... B65D 37/00; F05B 11/00

[52] U.S. Cl. ..... 222/207; 222/321; 222/341; 222/380; 417/566

[58] Field of Search ..... 222/206, 207, 209, 211, 222/212, 320, 321, 340, 341, 372, 380, 382, 383, 391, 470, 471, 476; 239/333; 417/566; 92/86.5, 89, 90

[56] References Cited

U.S. PATENT DOCUMENTS

| | | | |
|---|---|---|---|
| 2,368,091 | 1/1945 | Andersen | 103/148 |
| 2,476,545 | 7/1949 | Hayward | 17/479 |
| 2,702,147 | 2/1955 | Brown | 222/207 |
| 2,753,578 | 7/1956 | Lebet | 15/133 |
| 2,772,817 | 12/1956 | Jauch | 222/207 |
| 3,258,175 | 6/1966 | Taylor | 222/380 |
| 3,282,472 | 11/1966 | Roder | 222/321 |
| 3,485,419 | 12/1969 | Taylor | 222/340 |
| 4,046,495 | 9/1977 | Grimm, Jr. | 417/268 |
| 4,072,252 | 2/1978 | Steyns et al. | 222/341 |
| 4,101,057 | 7/1978 | LoMaglio | 222/207 |
| 4,153,186 | 5/1979 | Nye | 222/378 |
| 4,199,083 | 4/1980 | LoMaglio | 222/207 |
| 4,201,317 | 5/1980 | Aleff | 222/207 |
| 4,249,681 | 2/1981 | French | 222/380 |
| 4,301,948 | 11/1981 | Czech et al. | 222/341 |
| 4,330,071 | 5/1982 | Ohlson | 222/07 |
| 4,347,953 | 9/1982 | Bauer | 222/207 |

*Primary Examiner*—Joseph J. Rolla
*Assistant Examiner*—Michael S. Huppert
*Attorney, Agent, or Firm*—Roylance, Abrams, Berdo & Goodman

[57] ABSTRACT

A manually-operated pump dispenser for dispensing liquids from a container. The dispenser includes a one-piece housing coupled to the container, a dip tube extending from the housing into the container, a one-piece pump member which is slidably supported in the housing and which has a trigger extending therefrom and a nozzle member at the end, a pair of one-way valves supported by the housing and pump member, and a resilient, annular biasing member which engages the housing and pump member, has a stretchable portion providing a restoring force to the pump member and forms a part of at least one of the one-way valves in the dispenser. In a first embodiment, the biasing member forms a part of each of the one-way valves, and in a second embodiment, it forms a part of the inboard one-way valve. In this second embodiment, the outboard valve is formed by the nozzle member and the pump member.

15 Claims, 17 Drawing Figures

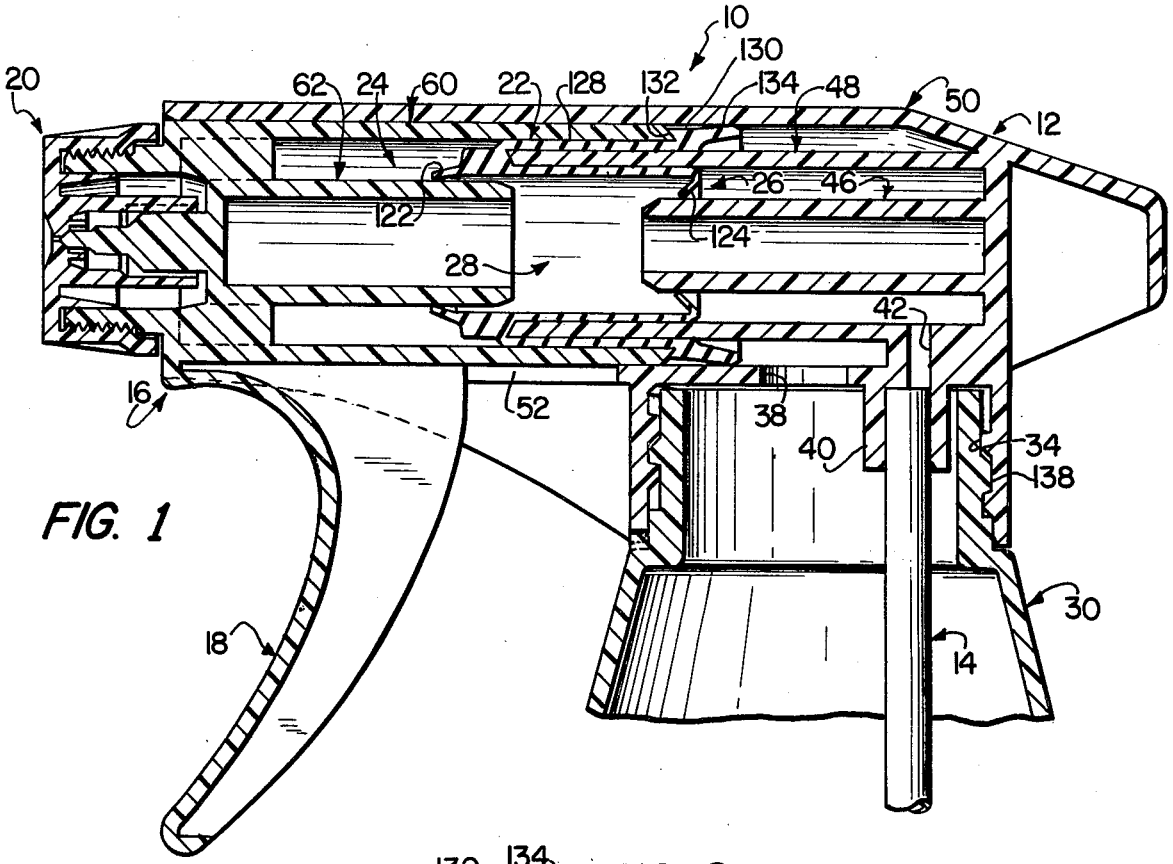
FIG. 1
FIG. 2
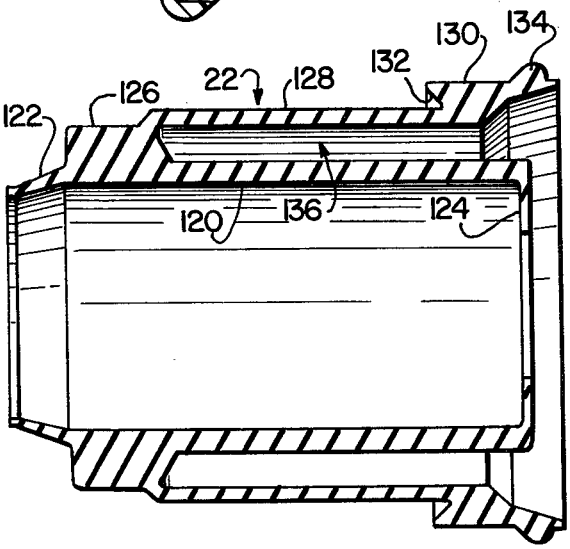
FIG. 3
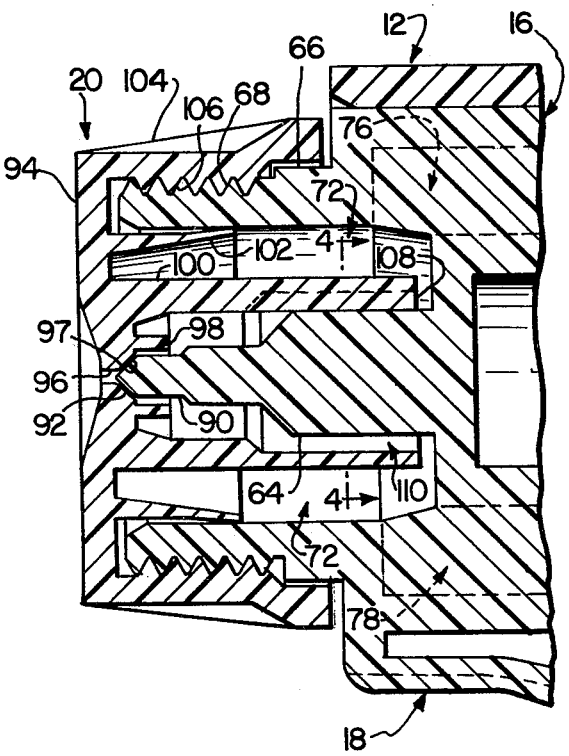
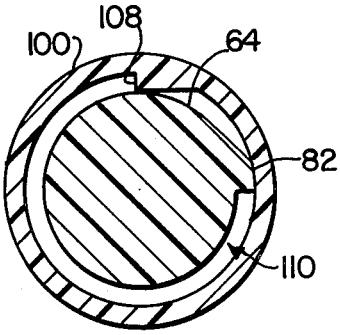
FIG. 4

FIG. 10
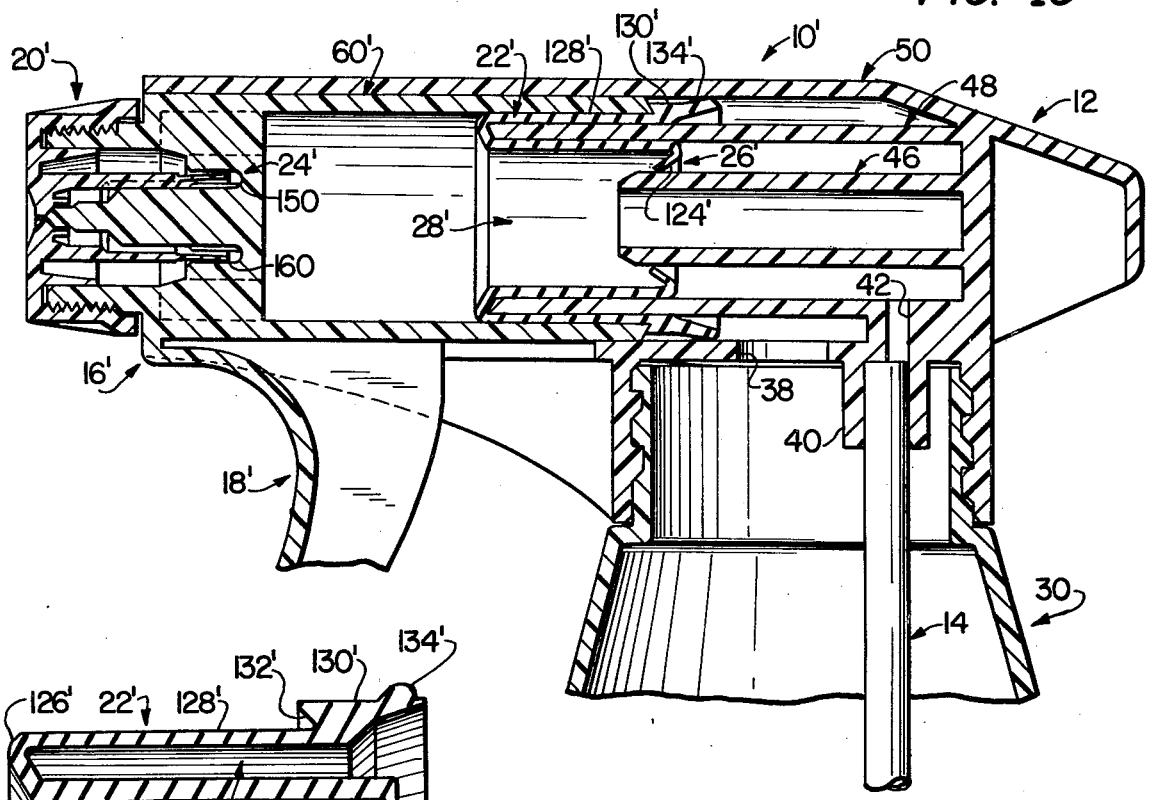
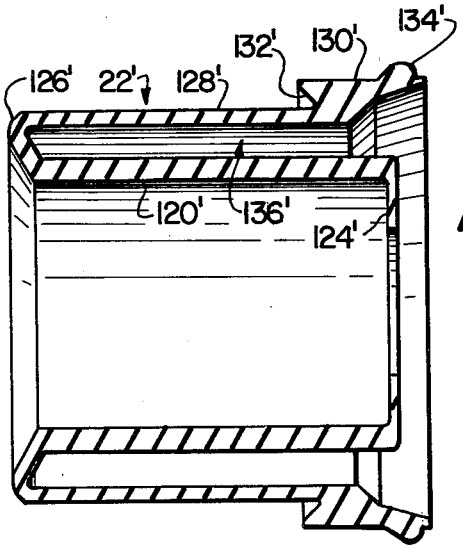
FIG. 11
FIG. 12
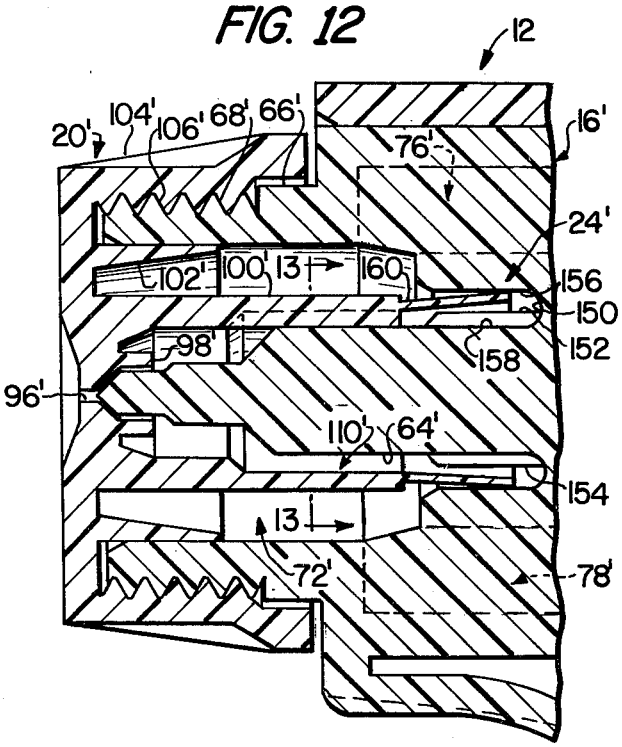
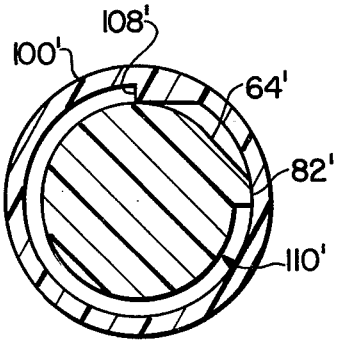
FIG. 13

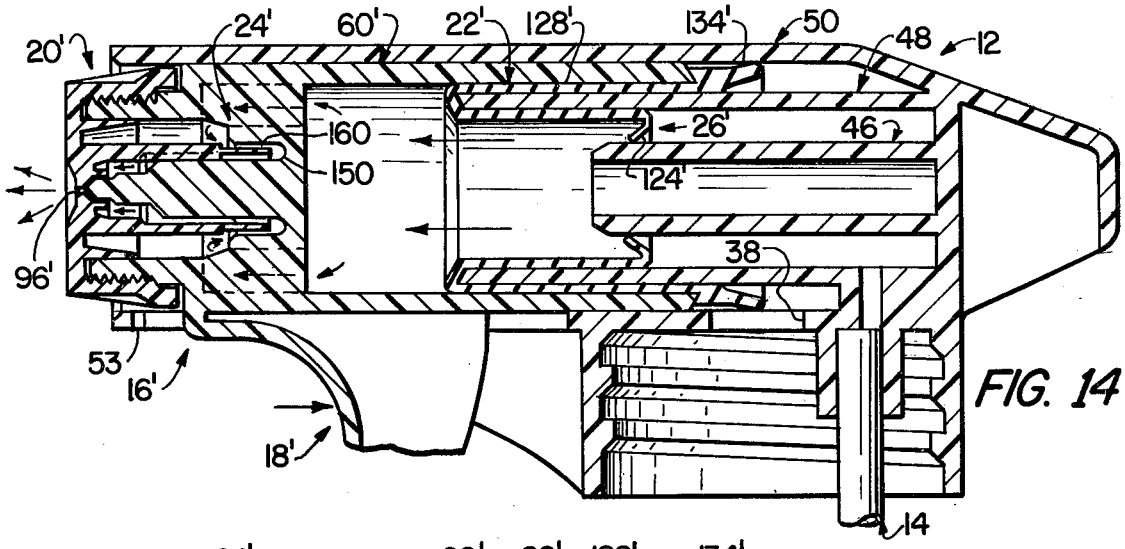
FIG. 14
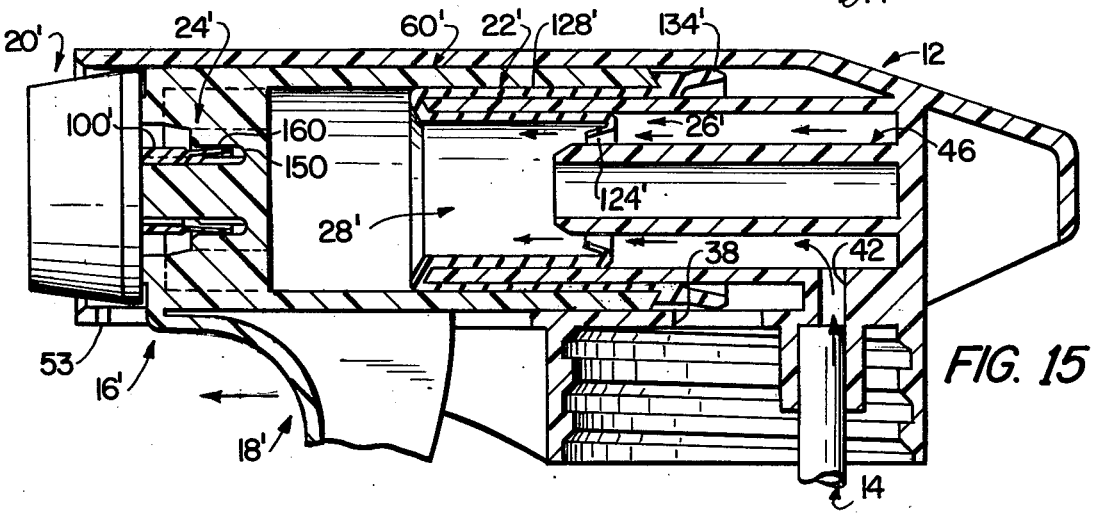
FIG. 15
FIG. 16
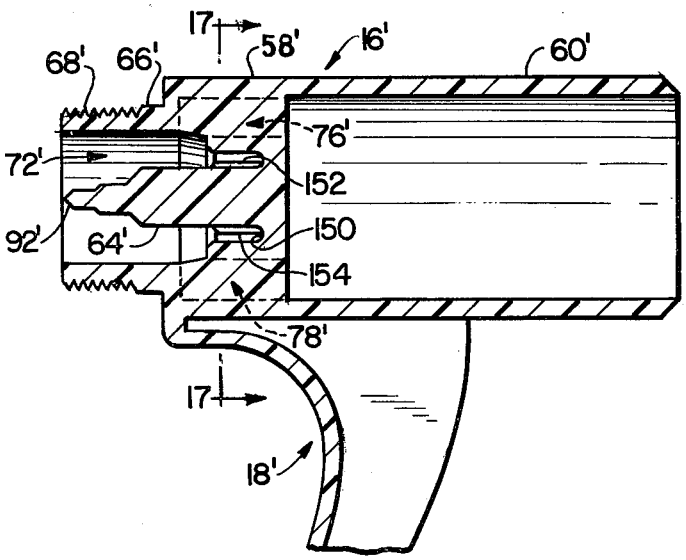
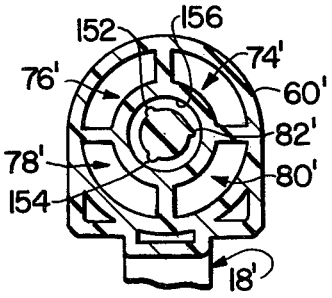
FIG. 17

PUMP DISPENSER WITH ONE-PIECE STRETCHABLE BIASING MEMBER AND VALVE

FIELD OF THE INVENTION

The invention relates to a manually-operated pump dispenser for dispensing liquids from a container. The dispenser includes a housing coupled to the container, a dip tube extending from the housing into the container, a pump member which is slidably supported on the housing and which has a trigger extending therefrom and a nozzle at the end, a pair of one-way valves, and a resilient, annular biasing member which engages the pump member and the housing, has a stretchable portion providing a restoring force to the pump member and forms a part of at least one of the valves in the dispenser.

BACKGROUND OF THE INVENTION

Manually-operated pump dispensers for dispensing liquids from a container have long been known. They are typically in two forms, one being commonly referred to as a trigger sprayer and the other being referred to as a finger pump. In the trigger sprayer, the operator's hand grasps a housing and the operator's index and middle fingers engage a trigger which is pivotable or longitudinally movable towards the housing to dispense liquid from a container coupled to the housing. In the finger pump type of dispenser the operator's hand once again grasps a housing and usually only the operator's index finger engages a vertically slidable pump member that reciprocates in the housing. These dispensers, in either form, thus typically comprise a housing and a movable pumping member with some sort of nozzle at the end of the movable member to dispense the liquid in a spray or stream. To provide the required pumping action, these devices require two one-way, or check, valves along the flow of the liquid and a biasing member to move the pump member away from the housing after it has been moved towards the housing.

While these devices are well known, there is a continued need for improvement in their construction and operation. Thus, many of the prior art devices have numerous parts, are complicated to manufacture, are not reliable since they tend to leak, and typically include expensive coiled, metallic springs and metallic ball valves.

Examples of these prior art devices are disclosed in the following U.S. Pat. Nos.: 2,368,091 to Andersen; 2,476,545 to Hayward; 2,702,147 to Brown; 2,753,578 to Lebet; 2,772,817 to Jauch; 3,258,175 to Taylor; 3,282,472 to Roder; 3,485,419 to Taylor; 4,072,252 to Steyns et al; and 4,101,057 and 4,199,083 to LoMaglio.

SUMMARY OF THE INVENTION

Accordingly, a primary object of the invention is to provide a pump dispenser that has a limited number of parts, is simple to construct and operate, resists leakage and avoids the use of an expensive coiled metallic spring or ball valve.

Another object of the invention is to provide a pump dispenser with a one-piece stretchable biasing member and valve to reduce the costs of manufacture of the dispenser.

Another object of the invention is to provide such a pump dispenser in which the one-piece stretchable biasing member forms a part of one or both of the one-way valves in the dispenser for ease of manufacture.

The foregoing objects are basically attained by providing in a manually-operated pump dispenser including a housing adapted to be coupled to a liquid-containing bottle and having a fluid passageway, a dip tube extending from the passageway into the bottle and a vent for venting the bottle to the atmosphere; a pump member having a fluid passageway with an exit orifice, and a finger engaging element, the pump member being slidably engaged with the housing; and a pair of one-way valves located along the pump member and the housing fluid passageways, the improvement comprising a one-piece, annular resilient member for biasing the pump member away from the housing, this resilient member including a first portion engaging the housing, a second portion engaging the pump member, and a stretchable portion located between the first and second portions which is longitudinally stretched upon movement of the pump member towards the housing.

In a first embodiment shown in FIGS. 1–9, the biasing member forms a part of both of the one-way valves.

In a second embodiment shown in FIGS. 10–17, the biasing member forms a part of the inboard one-way valve, the outboard valve being formed by a nozzle member and the pump member.

Other objects, advantages and salient features of the invention will become apparent from the following detailed description, which, taken in conjunction with the annexed drawings, discloses preferred embodiments of the invention.

DRAWINGS

Referring now to the drawings which form a part of this original disclosure:

FIG. 1 is an elevational view in longitudinal section of the first embodiment of the invention shown in its assembled, relaxed condition;

FIG. 2 is an enlarged elevational view in longitudinal section of the one-piece biasing member forming a part of the outboard and inboard valves as shown in FIG. 1;

FIG. 3 is an enlarged, fragmentary elevational view in longitudinal section of the nozzle member coupled to the end of the pump member;

FIG. 4 is an enlarged left side elevational view in section taken along line 4—4 in FIG. 3 showing the child-proof locking splines located on the pump member and the nozzle member;

FIG. 10 is an elevational view in longitudinal section of a second embodiment of the invention where the biasing member forms a part of only the inboard valve and the outboard valve is formed by the nozzle member and the pump member;

FIG. 11 is an enlarged elevational view in longitudinal section of the biasing member shown in FIG. 10;

FIG. 12 is an enlarged, fragmentary elevational view in longitudinal section of the outboard valve formed by the pump member and nozzle member;

FIG. 13 is an enlarged side elevational view in transverse section taken along line 13—13 in FIG. 12 showing the child-proof locking splines on the pump and nozzle members;

FIG. 14 is an elevational view in longitudinal section of the dispenser shown in FIG. 10 except that the pump member is moving towards the housing, thereby stretching the stetchable portion in the biasing member and the outboard valve is open to allow fluid to be expelled from the dispenser;

FIG. 15 is an elevational view similar to that shown in FIG. 14 except that the pump member is moving away from the housing under the influence of the stretched portion of the biasing member and the inboard valve is open to allow liquid to pass therethrough from the container;

FIG. 16 is an elevational view in longitudinal section of the pump member shown in FIG. 10 by itself; and FIG. 17 is a side elevational view in transverse section taken along line 17—17 showing a locking spline as well as two valve limiting splines located on the pump member.

DETAILED DESCRIPTION OF FIGS. 1-9

Figure 5:
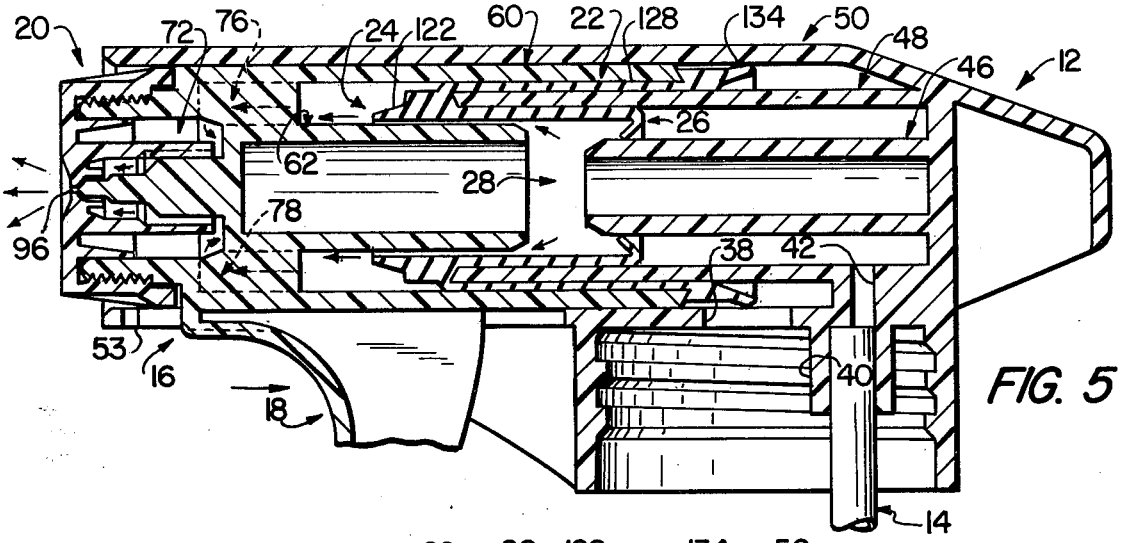
FIG. 5 is a fragmentary elevational view in longitudinal section similar to that shown in FIG. 1 except that the pump member is moving longitudinally towards the housing, thereby longitudinally stretching a portion of the biasing member, and the outboard valve is open to allow fluid to exit from the dispenser.

As seen in FIG. 1, the pump dispenser 10 in accordance with the invention is in its relaxed condition and comprises a housing 12, a dip tube 14 extending from the housing, a pump member 16 slidably engaged with the housing and having a trigger 18 extending therefrom and a nozzle member 20 at the end, a biasing member 22 for biasing the pump member away from the housing, an outboard valve 24, an inboard valve 26 and a product chamber 28 defined inside the dispenser. The housing 12 is coupled to the container or bottle 30 and the dip tube extends from the housing into the container. This container has a liquid therein which is dispensed in a stream or spray by means of longitudinal reciprocation of the pump member 16 relative to the housing 12. This reciprocation is accomplished by the operator gripping the housing and manually engaging the trigger with the index and middle fingers and pumping the pump member relative to the housing. This pumping alternately opens and closes the outboard and inboard valves, resulting in the desired dispensing of the liquid from the container. The restoring force provided to the pump member to move it away from the housing is generated by the potential energy created in the biasing member 22 as a portion of it is longitudinally stretched as the pump member is moved towards the housing as seen in FIG. 5.

Figure 6:
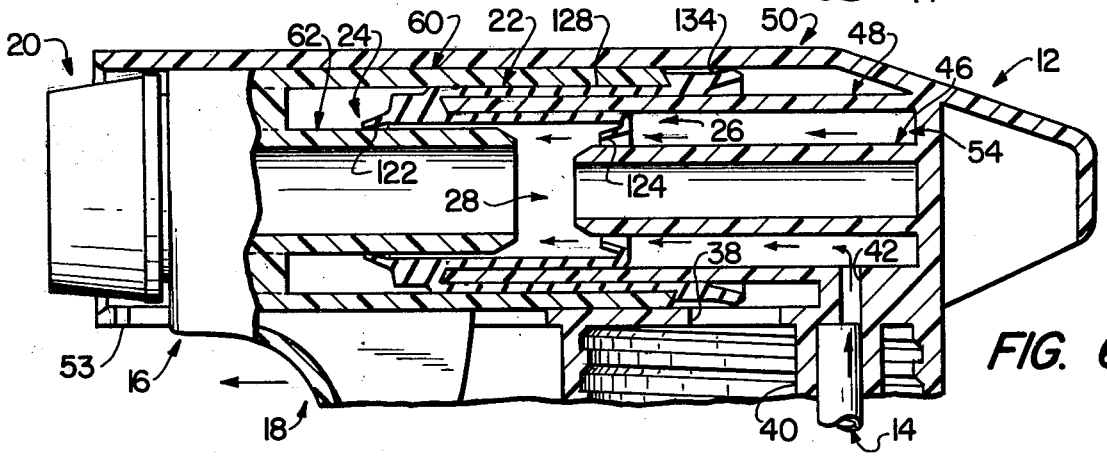
FIG. 6 is a fragmentary, elevational view in longitudinal section similar to that shown in FIG. 5 except that the pump member is moving away from the housing under the influence of the restoring force generated by the stretchable portion in the biasing member and the inboard valve is open to allow liquid from the container to move past this valve.
Figure 9:
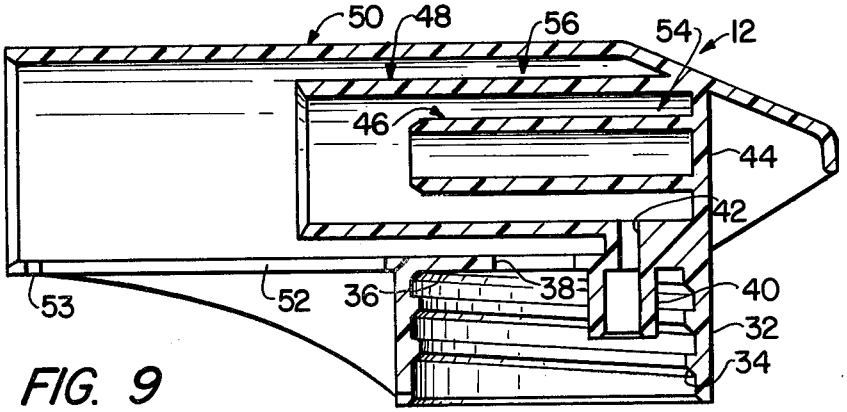
FIG. 9 is an elevational view in longitudinal section of the housing by itself.

Referring now to FIG. 9, the housing 12 is preferably formed of a rigid plastic, e.g., polypropylene or polyethylene as a one-piece member by injection molding. The housing has a vertically oriented cylindrical base 32 with threads 34 formed on the inside thereof and a horizontally oriented, disc-shaped wall 36 above the base 32 with a vertically oriented vent 38 formed centrally thereof. Extending downwardly from horizontal wall 36 is a vertically oriented cylindrical tube 40 for the reception of the dip tube 14, as seen in FIGS. 1, 5 and 6, this cylindrical tube 40 having a fluid passageway 42 of smaller diameter communicating therewith and formed in the wall 36. Extending upwardly from the rear of horizontal wall 36 is a vertical, curved rear wall 44 that has three horizontally oriented cylindrical and concentric tubes extending therefrom including an inner tube 46, a central tube 48 and an outer tube 50, which forms the outer surface of the housing and which has a longitudinal slot 52 at the bottom thereof in front of the cylindrical base 32. This slot receives the trigger 18 on the pump member. At the end of this slot are two opposed, inwardly facing locking lugs 53 which engage the trigger once the pump member is slid onto the housing to prevent disassembly of and provide an outward stop for the pump member. When the pump member is slid onto the housing, these lugs spread apart to allow the trigger past. The inner tube 46 is shorter than the central tube 48 which in turn is shorter than the outer tube 50. The inner tube 46 forms a valve seat and the cylindrical recess 54 between inner and central tubes 46 and 48 forms a fluid passageway communicating with fluid passageway 42 in the housing. Another cylindrical recess 56 is formed between the central and outer cylindrical tubes 48 and 50 for the slidable reception of the pump member 16 as seen in FIGS. 1, 5 and 6.

Figure 7:
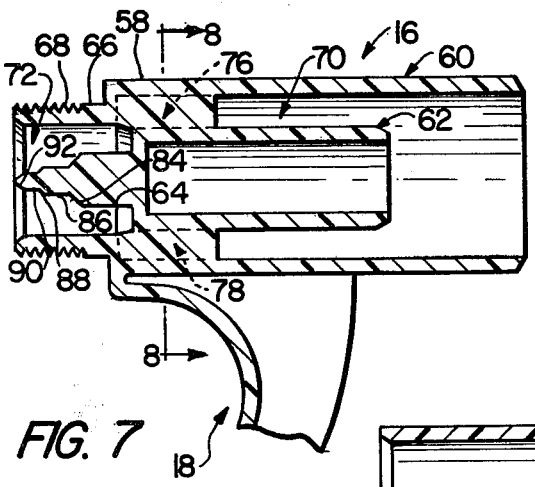
FIG. 7 is an elevational view in longitudinal section of the pump member by itself.
Figure 8:
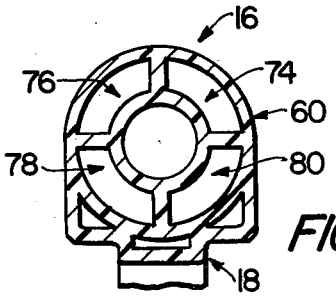
FIG. 8 is a side elevational view of the pump member in section taken along line 8—8 in FIG. 7.

Referring now to FIG. 7, the pump member 16 is shown by itself as being a one-piece member formed by injection molding and preferably of a rigid plastic, e.g., polypropylene or polyethylene. The pump member comprises an annular body member 58, an outer cylindrical tube 60 extending rearwardly from the body member, an inner cylindrical tube 62 extending rearwardly from the body member and inside and concentric to the outer tube 60, a cylindrical stem 64 extending forwardly from the body member and a cylindrical tube 66 extending forwardly from the body member concentric to the cylindrical stem 64 and having threads 68 on the exterior thereof. As seen in FIG. 7, the trigger 18 is integrally formed with the remaining parts of the pump member and extends downwardly from the outer cylindrical tube 60. The inner cylindrical tube 62 forms a valve seat for the outboard valve 24 and a cylindrical recess 70 defined between cylindrical tubes 60 and 62 forms a fluid passageway in the pump member. Similarly, the annular recess 72 defined between the stem 64 and cylindrical tube 66 forms a fluid passageway in the pump member. These recesses 70 and 72 are connected, as seen in FIG. 8, by four fluid passageways 74, 76, 78 and 80 formed through the body member 58. As seen in FIG. 4, the cylindrical stem 64 has a longitudinally extending locking spline 82 extending outwardly therefrom to prevent removal of the nozzle member 20 from the pump member as will be described in more detail hereinafter. The prevention of removal of the nozzle member is intended as a child-proof feature.

As seen in FIG. 7, the cylindrical stem 64 extends from the center of the body member 58 and has at its end a frustoconical surface 84 which extends into a reduced diameter cylindrical rod 66 which extends into a frustoconical surface 88, which in turn extends into a further reduced diameter cylindrical rod 90 having a frustoconical tip 92 at the end.

Referring now to FIG. 3, the nozzle member 20 is preferably injection molded and formed of polypropylene or polyethylene which is more resilient than the material forming the housing and pump member. The nozzle member comprises a disc-shaped body member 94 having a central exit orifice 96 therein with a rearwardly facing frustoconical counterbore 97. This orifice in conjunction with tip 92 and swirl member 98 provides a spray or stream of fluid as desired, this orifice forming a fluid passageway for the fluid in the dispenser. Extending from the rear of the body member 94 is the conventional two-part, swirl member 98, a longer outer cylindrical tube 100 concentric with member 98, a frustoconical sealing member 102 concentric to but on the outside of outer cylindrical tube 100, and a rim 104 having internal threads 106 for engaging threads 68 on the pump member 16.

As seen in FIG. 3, when these threads are engaged, the frustoconical sealing member 102 is biased into a sealing engagement with the inner cylindrical surface of cylindrical tube 66 on the pump member, member 98 surrounds cylindrical rod 90 on the end of the stem 64 and the outer cylindrical tube 100 surrounds stem 64. As seen in FIG. 4, a locking spline 108 extends radially inwardly of the outer cylindrical tube 100 into engagement with the outer surface of cylindrical stem 64. The two locking splines 82 and 108 will allow tube 100 to rotate clockwise relative to stem 64 as the nozzle member 20, with right-handed threads, is rotated onto the pump member 16. This is accomplished by a slight outward expansion of the cylindrical tube 100 as the locking splines slide past one another in the clockwise direction. However, each of these locking splines has a radially directed stop shoulder so that counterclockwise rotation through 360° of these two members would be prevented by an engagement of these shoulders. In all events, this feature is intended to prevent a child from inadvertently removing the nozzle member from the pump member.

As best seen in FIG. 3, fluid, i.e., air or liquid, can pass from the fluid passageways 74, 76, 78 and 80 in the pump member 16 to the orifice 96 by following a path from these fluid passageways through the cylindrical recess 72 between cylindrical tube 100 on the nozzle member and cylindrical tube 66 on the pump member, then between cylindrical tube 100 and stem 64 in a passageway 110 therebetween and then out the orifice 96, the frustoconical tip 92 being spaced from orifice 96 and bore 97 as illustrated in FIG. 3. This space is provided by rotating the nozzle member counter-clockwise relative to the pump member.

Referring now to FIG. 2, the biasing member 22 is shown by itself as consisting of a one-piece member formed of resilient material such as rubber. The biasing member comprises an inner cylindrical portion 120 having a frustoconical inwardly tapering lip 122 at the forward end and an annular radially inwardly facing lip 124 at the rear end, a central annular portion 126 extending radially outwardly from the inner portion adjacent the forward lip 122, an outer cylindrical portion 128 extending from the central portion 126 rearwardly and concentrically to the inner cylindrical portion, and an enlarged annular portion 130 on the rear end of the outer portion 128, this enlarged annular portion having an inwardly tapering frustoconical recess 132 at the forward end and an outwardly facing annular rib 134 at the rear end.

As seen in FIG. 1, the forward lip 122 of the biasing member 22 engages the outer surface of cylindrical tube 62 in the pump member and the rear lip 124 in the biasing member engages the outer surface of cylindrical tube 46 in the housing. Thus, lips 122 and 124 form valve members while cylindrical tubes 46 and 62 form valve seats. The cylindrical recess 136 as seen in FIG. 2 between inner and outer cylindrical portions 120 and 128 on the biasing member receives central cylindrical tube 48 in the housing so that the end of central tube 48 engages the central annular portion 126 of the biasing member to prevent gross rearward movement of the biasing member relative to the housing. The outer cylindrical portion 128, which is the stretchable portion of the biasing member, is located between cylindrical tube 48 on the housing and outer cylindrical tube 60 on the pump member with the free end of tube 60 being engaged in recess 132 in the enlarged annular portion 130 on the biasing member. Thus, a movement of the pump member towards the housing tends to stretch outer cylindrical portion 128 on the biasing member because of the engagement of cylinder 60 in recess 132, this stretching being shown in FIGS. 5 and 6. As also seen in FIGS. 1, 5 and 6, the annular rib 134 on the enlarged annular portion 130 in the biasing member is in a slidable, sealing engagement with the inner cylindrical surface of the outer cylindrical tube 50 in the housing. As seen in FIG. 1, this sealing engagement closes the vent 38 in the housing from communication with the atmosphere. However, as seen in FIGS. 5 and 6, when the pump member is moved towards the housing it moves the annular rib 134 past an edge of the vent 38 allowing the vent to communicate with the atmosphere along the annular space between the outer surface of the pump member and the inner surface of outer cylindrical tube 50 of the housing, this space being formed by the necessary tolerance to allow sliding movement of the pump member relative to the housing. Thus, the annular rib 134 is a vent regulating member for opening and closing the vent to the atmosphere.

As is evident from FIGS. 1 and 2, the forward lip 122 forms a valve member in the outboard valve 24 and the rear lip 124 forms a valve member in the inboard valve 26. As seen in FIG. 1, when lip 124 engages the outer surface of tube 46, it assumes a substantially frustoconical position.

As seen in FIG. 1, the container 30 has external threads 138 thereon for engaging with internal threads 34 in the housing to secure the container to the housing. Any other suitable connection can be used to connect these members, advantageously this connection including a gasket or some similar device, not shown, to make this connection substantially air-tight and leak-proof.

As seen in FIG. 1, a product chamber 28 is formed by the pump member, the biasing member and the housing, the size of this product chamber being variable depending upon the volume of the bores in cylindrical tubes 46 and 62 in the housing and the pump member.

OPERATION

As seen in FIG. 1, the pump dispenser 10 in accordance with the invention is in its rest, relaxed position with both one-way valves 24 and 26 being closed.

With liquid in the container 30 and the nozzle member open, the trigger 18 is engaged by the operator to pull the pump member 16 towards the housing in a longitudinally sliding movement as seen in FIG. 5. This movement causes the stretchable cylindrical portion 128 on the biasing member to stretch longitudinally as seen in FIG. 5 and also causes the expelling of air from the product chamber 28 past outboard valve 24 and out the orifice 96 in the nozzle member. The outboard valve 24 opens under the air pressure created by this movement as forward lip 122 is biased radially outwardly away from engagement with cylindrical tube 62. The air then moves through the recess 70 between tubes 60 and 62 in the pump member, through fluid passageways 74, 76, 78 and 80 in the pump member, between the nozzle member cylindrical tube 100 and pump member stem 64 through recess 110, as seen in FIG. 3, and then out the orifice 96 as indicated in FIG. 5.

The operator's pressure on the trigger 18 is then released and the stored potential energy in the stretched cylindrical portion 128 drives the pump member away from the housing as indicated in FIG. 6.

A partial vacuum is formed in product chamber 28 as the pump member moves away from the housing, and thus liquid from the container moves into the product chamber past the inboard valve 26 as seen in FIG. 6. This valve opens since lip 124 is driven away from cylindrical tube 46 by the movement of the liquid into the product chamber. The liquid moves from the container 30 up the dip tube 14, through fluid passageway 42 in the housing, along the cylindrical recess 54 between tubes 46 and 48 in the housing and then through the gap between lip 124 and tube 46.

When forward movement of the pump member is completed, the next movement of the pump member towards the housing will expel the liquid in the product chamber 28 out of the nozzle member 20 as seen in FIG. 5 as outboard valve 24 opens under the influence of the liquid moving past it.

EMBODIMENT OF FIGS. 10–17

In the embodiment of FIGS. 10–17, the construction of the pump dispenser 10' is similar to that shown in FIGS. 1–9 and explained above regarding pump dispenser 10 except that the biasing member forms only a part of the inboard valve and the outboard valve is formed by the nozzle member and the pump member.

The housing 12 is the same in both embodiments as are the dip tube 14 and container 30. Thus, the same reference numerals are used in the embodiment of FIGS. 10–17.

The pump member in this second embodiment is the same as pump member 16 in the first embodiment with the addition of a cylindrical recess 150 seen in FIGS. 10, 12 and 14–16 and a pair of limiting splines 152 and 154 seen best in FIGS. 16 and 17. Because the remaining parts of the pump member 16' are the same as those discussed above their reference numerals will be used again in this section regarding the second embodiment but with a prime. In addition, as seen by comparing FIGS. 7 and 16, the inner cylindrical tube 62 in FIG. 7 is eliminated and the body member 58' is without a central bore.

As seen best in FIG. 12, the forwardly opening cylindrical recess 150 formed in pump member 16' has a radially inwardly facing cylindrical surface 156 and a radially outwardly facing cylindrical surface 158. The limiting splines 152 and 154 extend from surface 158, with surface 156 acting as a valve seat as will be described in more detail hereinafter.

The nozzle member 20' is the same as that shown and described above regarding the first embodiment except that it has at the end of cylindrical tube 100' an outwardly diverging frustoconical member 160 as best seen in FIG. 12. This member is in engagement with cylindrical recess 156 and forms a valve member for the outboard valve 24'. The remaining parts of the nozzle member are the same as those discussed above regarding FIGS. 1–9 and are thus given the same reference numerals but with a prime.

As seen in FIGS. 12 and 14, valve 24' will open when frustoconical member 160 is biased radially inwardly away from cylindrical surface 156. To prevent frustoconical member 160 from completely engaging cylindrical surface 158 and thereby closing off a fluid passageway, the limiting splines 152 and 154 are used to keep member 160 from completely engaging surface 158.

As seen in FIG. 11, the biasing member 22' is the same as that described above regarding the first embodiment except that the forward lip 122 is removed. The remaining parts are the same as those discussed above regarding FIGS. 1–9 and are thus given the same reference numerals but with a prime.

OPERATION

The second embodiment shown in FIGS. 10–17 operates generally like the first embodiment, with the inboard valve 26' operating exactly the same way.

The outboard valve 24' operates differently since the pump member and nozzle member form this valve. Thus, as seen in FIG. 14, when the trigger 18' is engaged and the pump member 16' moves towards the housing 12, air or liquid will move over the frustoconical member 160 driving it radially inwardly into engagement with limiting splines 152 and 154 as seen specifically in FIG. 14. Then, the fluid moves towards and through the orifice 96' between stem 64' and the remaining structure of the nozzle member 20' as discussed above regarding the first embodiment.

While various embodiments have been chosen to illustrate the invention, it will be understood by those skilled in the art that various changes and modifications can be made therein without departing from the scope of the invention as defined in the appended claims.

What is claimed is:

1. In a manually-operated pump dispenser including a housing adapted to be coupled to a liquid-containing bottle and having a fluid passageway, a dip tube extending from the passageway into the bottle and a vent for venting the bottle to the atmosphere; a pump member having a fluid passageway with an exit orifice, and a finger engaging element, the pump member being slidably engaged with the housing; and a pair of one-way valves located along the pump member and the housing fluid passageways, the improvement comprising:

a one-piece, annular resilient member for biasing the pump member away from the housing, said resilient member including a first portion engaging the housing, a second portion engaging the pump member, and a stretchable portion located between said first and second portions which is longitudinally stretched upon movement of the pump member towards the housing.

2. A pump dispenser according to claim 1, wherein said resilient member is formed of rubber.

3. A pump dispenser according to claim 1, wherein said resilient member forms a part of one of the pair of one-way valves.

4. A pump dispenser according to claim 1, wherein said resilient member forms a part of both of the one-way valves.

5. A pump dispenser according to claim 1, wherein the pump member has a substantially cylindrical valve seat located in the fluid passageway therein, the housing has a substantially cylindrical valve seat located in the fluid passageway therein, and said resilient member has a first valve member engaging said cylindrical valve seat in the pump member and a second valve member engaging said cylindrical valve seat in the housing, thereby forming the pair of one-way valves.

6. A pump dispenser according to claim 5, wherein said first and second valve members engage the outer surfaces of said valve seats.

7. A pump dispenser according to claim 1, wherein the housing has a substantially cylindrical valve seat located in the fluid passageway therein, and said resilient member has a valve member engaging said valve seat in the housing, thereby forming one of the pair of one-way valves.

8. A pump dispenser according to claim 7, wherein said valve member engages the outer surface of said valve seat.

9. A pump dispenser according to claim 1, wherein the housing includes a cylindrical portion containing the vent therein, and said resilient member further includes a vent regulating portion in slidable engagement with the housing cylindrical portion for movement with the pump member from a first position sealing the vent from the atmosphere to a second position opening the vent to the atmosphere.

10. A pump dispenser according to claim 1, wherein the pump member supports one of the one-way valves adjacent the exit orifice.

11. A pump dispenser according to claim 10, wherein the one-way valve supported by the pump member comprises a cylindrical recess in the pump member, and a frustoconical valve member engaging a surface in said cylindrical recess.

12. A pump dispenser according to claim 1, wherein said stretchable portion is located between the pump member and the housing.

13. The pump dispenser according to claim 1, wherein said stretchable portion is cylindrical.

14. A pump dispenser according to claim 1, wherein the pump member is formed as a one-piece element.

15. A pump dispenser according to claim 1, wherein the housing is formed as a one-piece element.

* * * * *